US006994049B1

(12) United States Patent
Schulz

(10) Patent No.: US 6,994,049 B1
(45) Date of Patent: Feb. 7, 2006

(54) POWER BOAT WITH IMPROVED HULL

(75) Inventor: Walter A. Schulz, Portsmouth, RI (US)

(73) Assignee: Shannon Yachts, LLC, Bristol, RI (US)

( * ) Notice: Subject to any disclaimer, the term of this patent is extended or adjusted under 35 U.S.C. 154(b) by 0 days.

(21) Appl. No.: 10/447,938

(22) Filed: May 29, 2003

(51) Int. Cl.
*B63B 1/24* (2006.01)

(52) U.S. Cl. ..... 114/274

(58) Field of Classification Search ..... 114/274
See application file for complete search history.

(56) References Cited

U.S. PATENT DOCUMENTS

| | | | | |
|---|---|---|---|---|
| 518,702 | A | 4/1894 | Schermerhorn | |
| 1,581,881 | A | 4/1926 | Smith | |
| 2,185,430 | A | 1/1940 | Burgess | |
| 2,369,633 | A | 2/1945 | Higgins | |
| 2,634,698 | A | 4/1953 | Becker | |
| 2,887,978 | A | 5/1959 | Tritt | |
| 2,915,031 | A | 12/1959 | Johnston | |
| D190,348 | S | 5/1961 | Tritt | |
| 3,010,419 | A | 11/1961 | Costa et al. | |
| 3,085,535 | A | 4/1963 | Hunt | |
| 3,259,093 | A | 7/1966 | Taylor | |
| 3,303,809 | A | 2/1967 | Ross | |
| 4,128,072 | A | 12/1978 | Wood, Jr. | |
| 4,449,468 | A | 5/1984 | Schulz | |
| 4,753,184 | A | 6/1988 | Schiavone | |
| 4,875,425 | A * | 10/1989 | Serter | 114/61.27 |
| 5,063,868 | A | 11/1991 | Fink, Jr. | |
| 5,191,853 | A * | 3/1993 | Adler | 114/291 |
| 5,419,274 | A | 5/1995 | van Diepen | |
| 5,456,202 | A | 10/1995 | Schoell | |
| 5,636,585 | A | 6/1997 | Schulz | |
| D429,682 | S | 8/2000 | Garland et al. | |
| 6,176,196 | B1 | 1/2001 | Halter | |
| 6,325,009 | B1 | 12/2001 | Schulz | |
| 2004/0103836 | A1 * | 6/2004 | Burkett | 114/271 |

FOREIGN PATENT DOCUMENTS

| | | |
|---|---|---|
| FR | 2577508 | 8/1986 |

OTHER PUBLICATIONS

Grady-White Boats Inc., "Design Registration No. DVH 0004/1," Grady-White Express 26, ( Sep. 8, 1999).
Outboard Marine Corporation, "Design Registration No. DVH 0035," Four Winns 260 Horizon (2000 model year), ( Apr. 4, 2000).
Outboard Marine Corporation, "Design Registration No. DVH 0037," Four Winns 280 Horizon (2000 model year), ( Mar. 31, 2000).
L&B Technology, Inc., "Design Registration No. DVH 0067," Seaview 36 Open Express Sport Fisherman Hook'm Series, ( Aug. 23, 2001).

* cited by examiner

*Primary Examiner*—Stephen Avila
(74) *Attorney, Agent, or Firm*—Bowditch & Dewey, LLP

(57) ABSTRACT

A power boat having an improved hull including concave aft sections, and which hull is capable of operations at a wide range of speeds with low relative horsepower for vessel weight and improved fuel economy is disclosed. In one exemplary embodiment, the boat is a 38 foot power boat having an improved hull which can achieve speeds of up to about 18 knots, with a 200 hp engine and which burns about 10 gals. per hour. The hull preferably includes a negative deadrise angle at the aft sections, the deadrise angle being positive at the bow and transitioning to a negative angle at the aft sections of the hull.

6 Claims, 8 Drawing Sheets

POWER BOAT WITH IMPROVED HULL

DESCRIPTION

1. Technical Field

The invention relates generally to an improved hull design for a power boat and, more specifically, to a power boat having an improved hull design shape including concave aft sections and improved lifting surfaces for increasing fuel efficiency and operating.

2. Background of Related Art

Power boating has become an increasingly popular past time around the world. In addition to recreational use of power boats, power boats are also utilized in commercial and military settings. Generally, the use of the boat determines the type of hull which will be utilized in constructing the boat. For example, many people who operate power boats for recreation require increased speed for sports such as water skiing, while also requiring stability for safety. In addition, many recreational consumers require cabins for comfort and want fuel efficiency for economic and environmental reasons. In contrast, commercial boats may require less speed, but more stability for their particular application, and fuel efficiency remains a concern. Conventional hull shapes for mono-hull boats can be generally characterized as displacement type hulls, semi-displacement type hulls and planing hulls.

Displacement hulls utilized in power boats are well known in the art. Such hulls have a shape which is not overly sensitive to weight, but which does not exhibit any lift characteristics. Lift is the force that enables a hull to raise up out of the water as the forward thrust provided by the engine and propeller increase, thereby increasing the boat's speed as wetted surface is decreased. Thus, while displacement type hulls afford the operator with seaworthy characteristics, top speeds of these vessels are generally governed by waterline length. The maximum speed of displacement hulls has been conventionally accepted to be limited to the theoretical hull speed formula computed by multiplying the square root of the length of the hull's waterline ($W_L$) by 1.4, i.e. maximum speed $=1.4(\sqrt{W_L})$. For example, a boat with a 30 foot waterline should have a theoretical maximum hull speed of about 7 knots. Beyond their theoretical optimal speed conventional displacement hulls begin to sink into the water, rather than lift out of the water, thereby decreasing their speed. Thus, increasing horsepower does not equate in such hulls to an increased speed, but rather can lead to the hull being driven lower into the water and increasing the wetted surface, reducing speed to a point that the vessel can actually sink. Generally, displacement type hulls are utilized for long range power boats, where weight carrying and fuel tankage capabilities for providing range outweigh the need for increased speed. In addition, due to their round shaped hull sections, displacement powerboats tend to have a rolling motion in a seaway and generally require some method of roll dampening, typically by using paravanes or gryro controlled underwater fins. Even displacement vessels as large as 600 foot passenger cruise ships use roll dampening devices for passenger comfort.

Another style hull which is utilized in power boats, such as lobster boats, is a semi-displacement hull. Semi-displacement hulls partially lift out of the water as forward propulsion is increased, but at the same time the wave created by the bow is increased creating drag as speed and power are increased. Semi-displacement hulls have advantages for use as fishing boats and commercial craft as their speed can be adjusted based on the load carried by the boat. Motion in a seaway for semi-displacement hulls is generally better than displacement hulls due to their flat aft sections. However, offshore fishing vessels still utilize paravanes on the outriggers for dampening rolling action to allow the crew to operate safely. Semi-displacement hulls are normally not as fast as planing hulls, but are faster than displacement hulls. Conventionally powered and loaded semi-displacement hulls normally operate at 2.0 to 2.3 times the square root of the waterline length. However, because of the bow wave factor and the drag created by their very flat (almost horizontal deadrise) aft sections of the hull, such semi-displacement hulls require a significant amount of power to operate at higher speeds, regardless of load. For example, a 35 foot semi-displacement hull boat having a single, 350 hp engine would typically burn about 20 gals. per hour at a maximum speed of about 14 knots.

Planing hulls generate lift as forward propulsion is increased, reducing the amount of hull which is in the water and dramatically increasing speed as compared to displacement type hulls. Most currently available power boats utilized deep V-shaped hulls or moderate deep vee shapes. While the speed of such boats is good, they require large amounts of horsepower and, consequently, burn a considerable amount of fuel in order to get the hull out of the water to attain the faster speeds. For example, a 40 foot deep V hull boat having twin 350 hp engines would typically burn about 40–50 gals. per hour at a maximum speed of about 25 knots. In addition, a planing hull is very sensitive to allowable weight, limiting the amount of fuel that can be carried, thus limiting range of operation. Speeds in excess of 80 knots have been achieved in planing hulls using enormous power plants with significant fuel burn. Approx. 80% of the pleasure power boats in the United States use planing hulls because of their speed and comfortable motion in flat and moderate seas. However, maintaining minimum planing speeds, usually in excess of 12 to 14 knots, in high sea conditions can be very uncomfortable due to the pounding motion created by the flat hull sections. Using a planing hull at speeds below planing speed can also be uncomfortable due to the hull shape which obtains it's stability from water moving fast across the underwater sections of the hull.

Improvements to all hull types are continually being made in an effort to optimize specific hull characteristics, according to the particular use of the boat. However, to date no hull design has been developed for power boats which has successfully exhibited good fuel economy and range at variable operating speeds while also providing a stable, comfortable ride.

Accordingly, there is needed in the art a power boat having a hull design which exhibits good to excellent fuel economy and range at variable operating speeds, while also providing a stable, comfortable ride.

SUMMARY

One object of the present invention is provide a power boat capable of providing good fuel economy and range of travel at variable speeds while also having good stability as compared to power boats having conventional hulls.

This object is achieved in accordance with one aspect, by a power boat having an improved hull design including a reverse deadrise aft portion, i.e. a concave rear bottom portion as measured relative to a static waterline, and which hull is capable of operations at all speeds with decreased horse power and increased fuel efficiency as compared to conventional hulls. In one exemplary embodiment, the boat is a 38 foot power boat having an improved hull which can achieve speeds of up to about 18 knots, with only a 200 hp engine and which burns about 10 gals. per hour. In this embodiment, the operating range with 250 gals of fuel would be approximately 375 miles. The hull includes concave aft sections which results in a negative deadrise angle. The overall shape of the hull includes a "twisted" configuration, with a deadrise angle at the forward sections of about equal to or greater than fifty-two (52) degrees positive, with the deadrise angle midship being about equal to or greater than twenty-eight (28) degrees positive, and at the deadrise angle at the aft sections being about equal to or greater than negative ten (−10) degrees as measured straight across the concave aft sections.

The hull may further include a pronounced hollow in the underside or bottom portion of the hull, which lies substantially 40% to 70% aft of the bow and below the waterline. The provision of a hull having a hollow area operates to direct the flow of water traveling under the hull toward the concave aft sections. This hollow area also induces turbulence in the water as it travels toward the aft sections of the boat thus breaking any suction or surface skin friction in the aft sections as the boat passes through the water.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
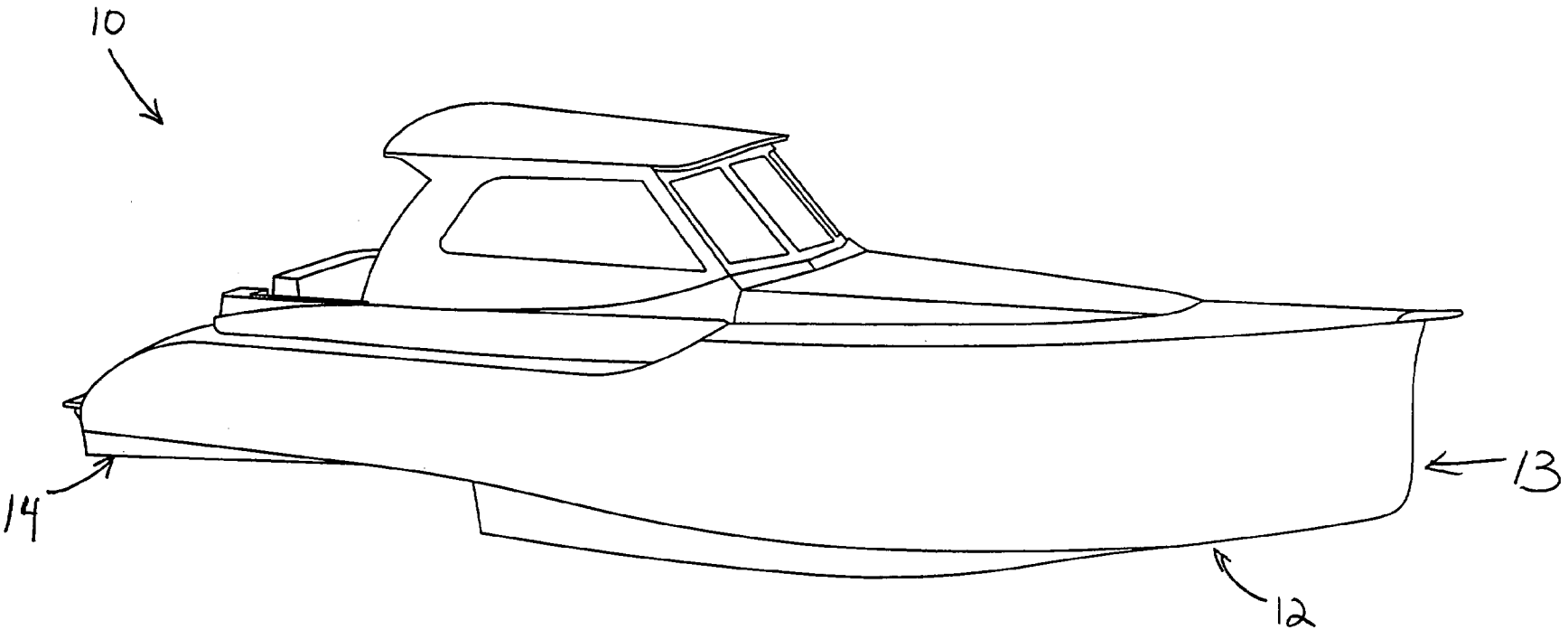
FIG. 1 is a front perspective view of a power boat having an improved hull according to the present disclosure.
Figure 2:
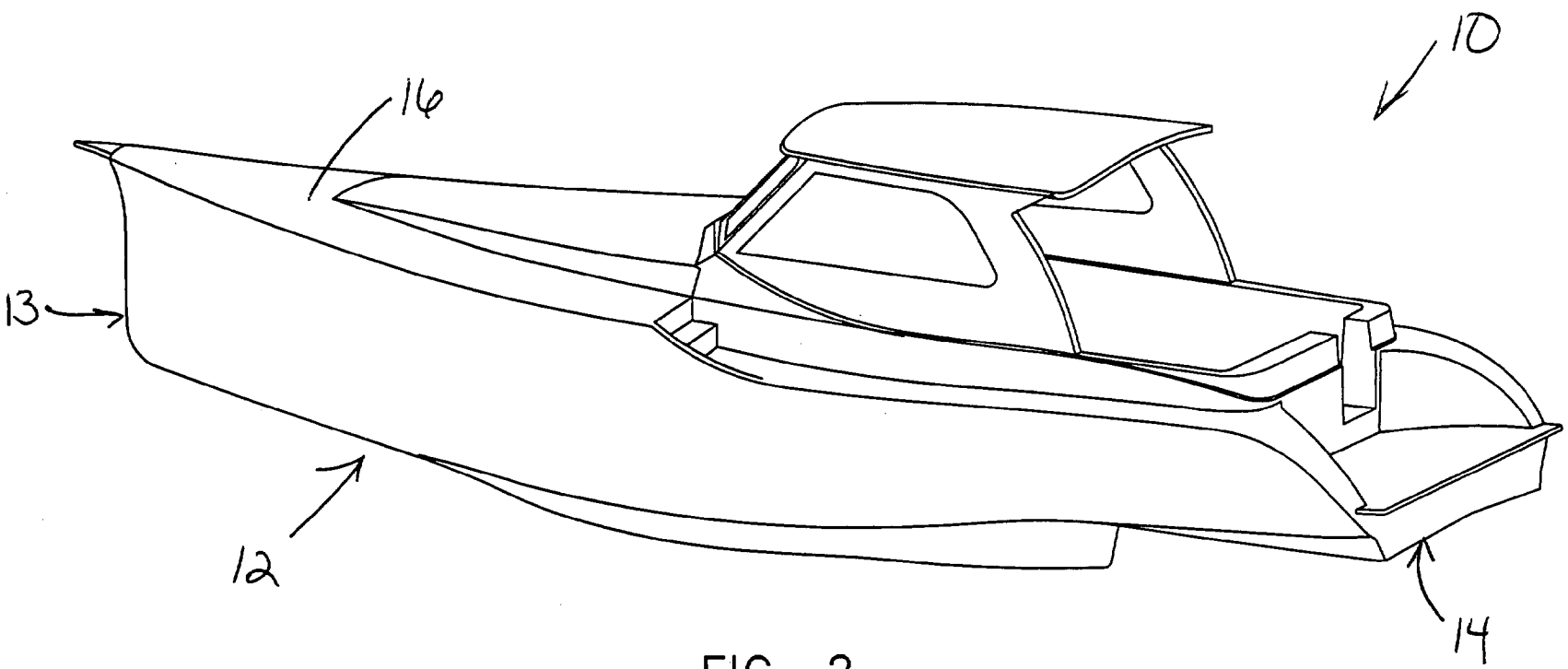
FIG. 2 is a rear perspective of the power boat of FIG. 1.
Figure 4:
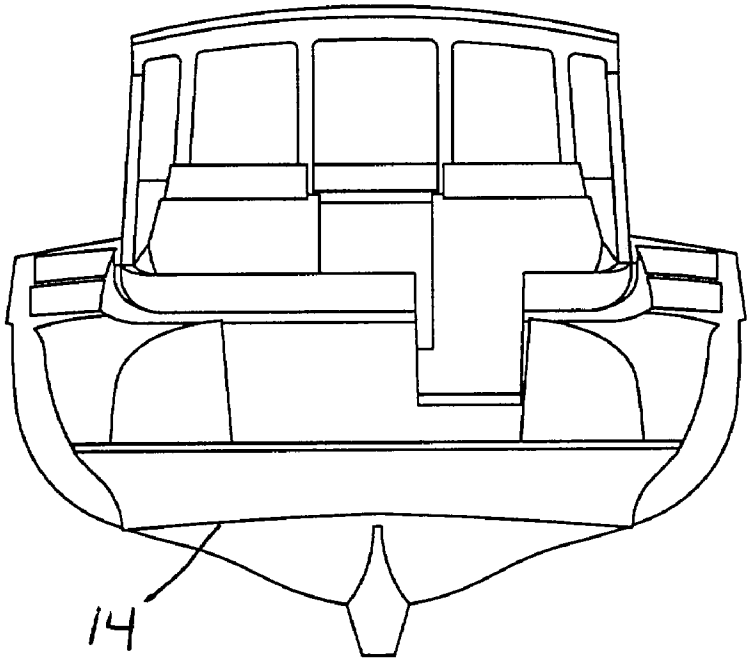
FIG. 4 is a rear elevational view of the power boat of FIG. 1.
Figure 3:
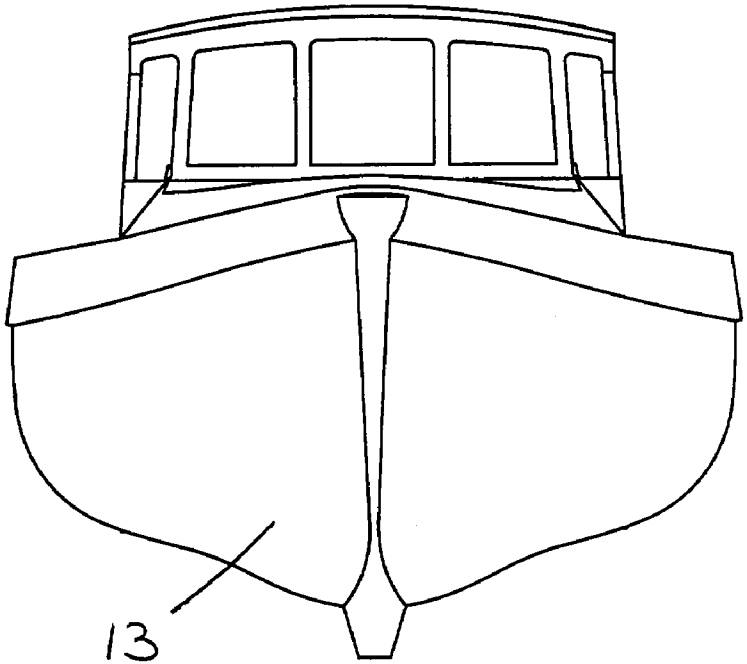
FIG. 3 is a front elevational view of the power boat of FIG. 1.
Figure 5:
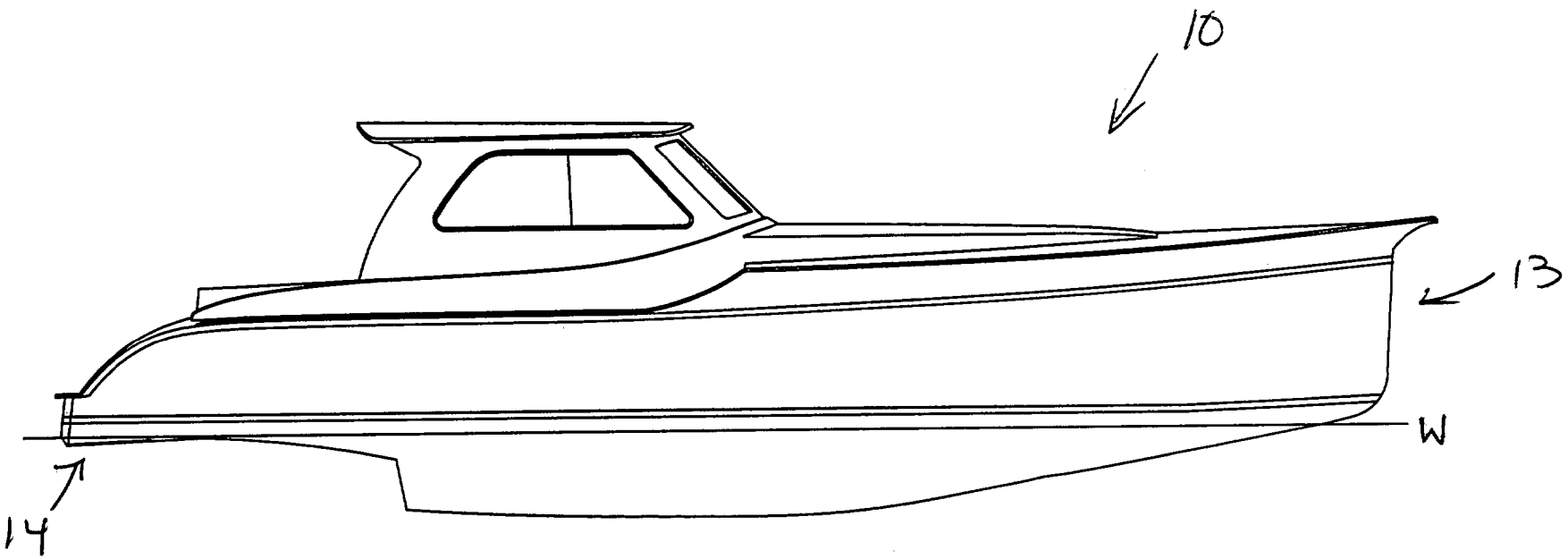
FIG. 5 is a side elevational view of the power boat of FIG. 1.
Figure 6:
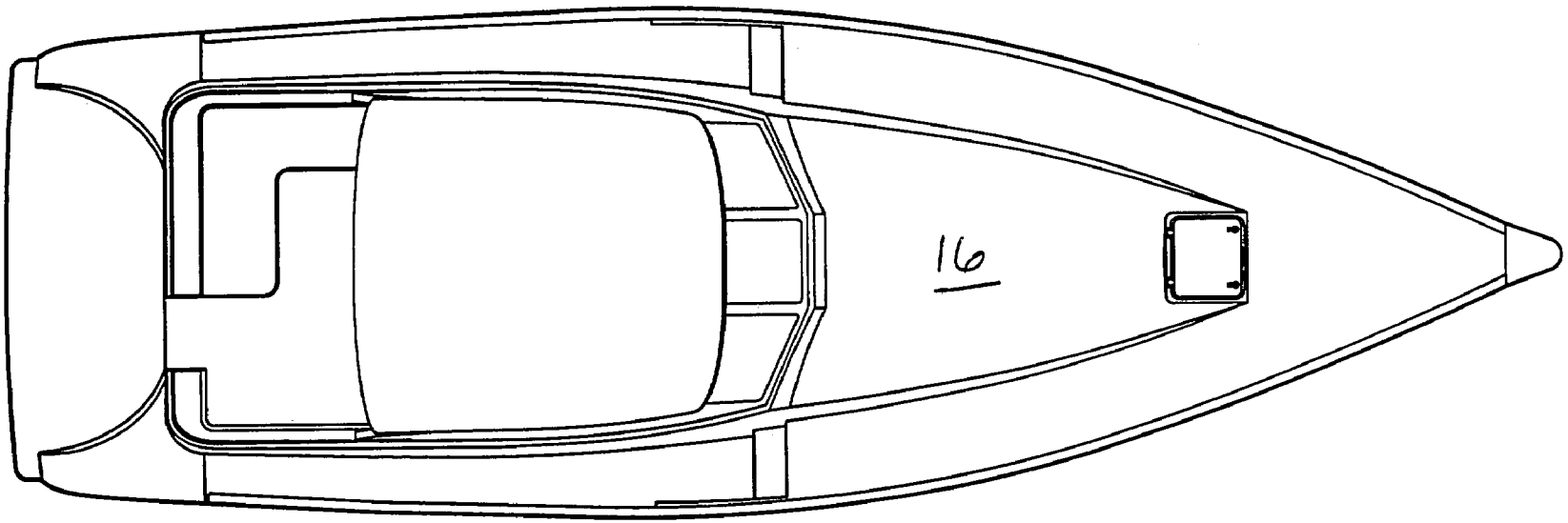
FIG. 6 is a top plan view of the power boat of FIG. 1.

A power boat 10 having an improved hull 12 is illustrated in FIGS. 1–10. As used herein, the term "bow" refers to the front portion of the boat and the term "transom" refers to the rear portion of the boat at which point the hull terminates, opposite the hull, as is conventional. Likewise, the term "forward" or "forward sections" refers to approximately the front ⅓ of the boat's hull as measured from the bow (or stations 0 to 4 in the present embodiment), "midship" or "amidship" refers to approximately the middle or second ⅓ of the boat's hull as measured from the bow (or stations 5 to 8 in the present embodiment), and "aft" or "aft sections" refers to approximately the rearmost ⅓ of the boat's hull as measured from the bow (or stations 9 to "T" in the present embodiment). As also used herein, the term "waterline length" or "length at the waterline" refers to the length of the boat as measured along the waterline "W" when the boat is static, as is also conventional. In the illustrative embodiment, a power boat having an overall length ($O_L$) of about 38 feet and a length at the waterline ($W_L$) of about 36 feet is described. However, it is to be understood that the invention is not limited to such a size boat, and expressly includes boats of varying lengths and widths. The description that follows relating to a 38 foot boat is for illustrative purposes only.

Figure 7:
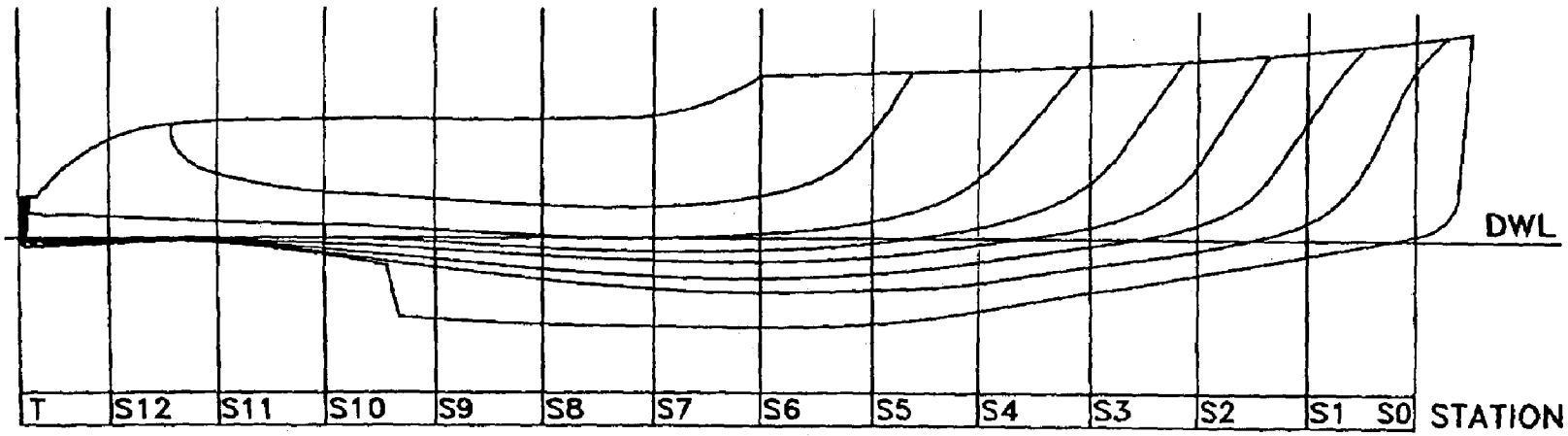
FIG. 7 is a schematic view of the hull showing the sectional lines of the hull representing individual stations from a side view thereof.
Figure 8:
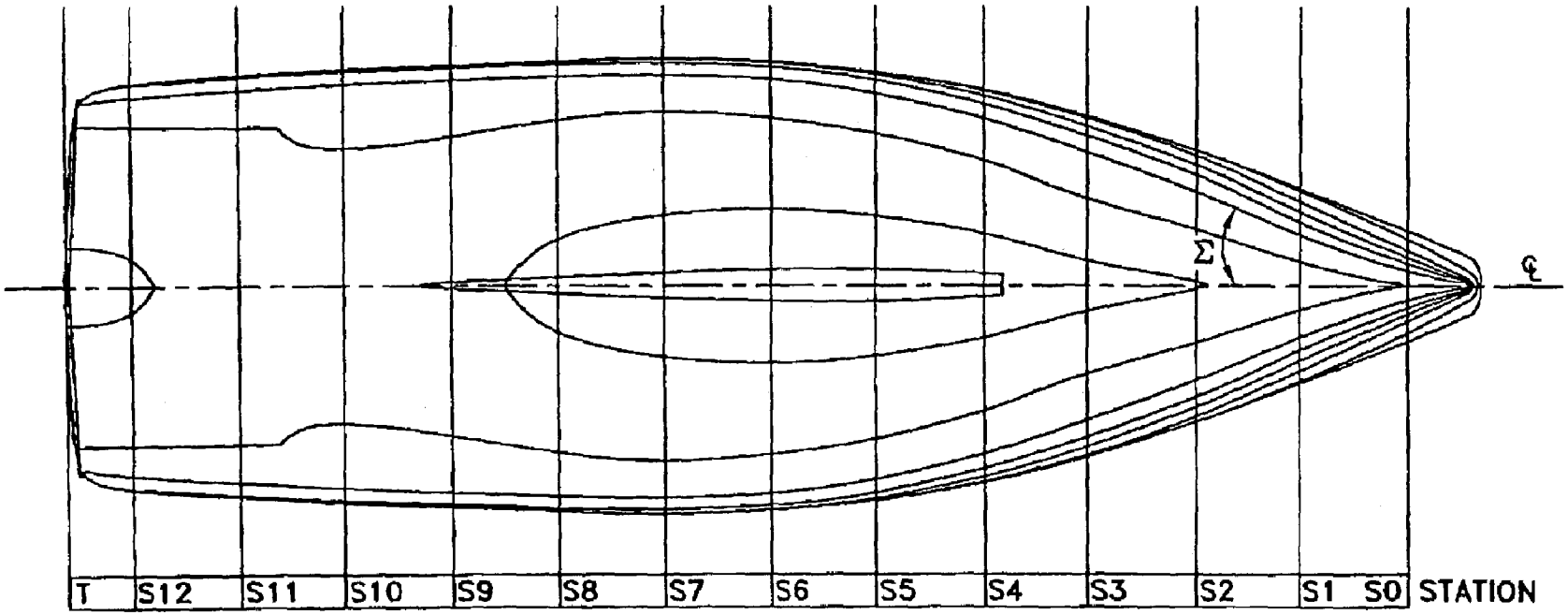
FIG. 8 is a bottom view of the power boat of FIG. 1.

The hull 12 of the present embodiment preferably has a hydrodynamic shape including a "twist" configuration which provides lift as well as stability at operating speeds of up to about 20 knots for a 38 foot power boat having a length at its waterline ($W_L$) of approximately 36 feet. As shown in FIG. 7, the hull is divided into "stations", as is conventional. The hull 12 of the present invention preferably includes 13 stations, labeled S0, S1, S2, S3, S4, S5, S6, S7, S8, S9, S10, S11, S12 and "T" respectively. The stations are preferably divided into equal parts, with the exception of station "T" which is uneven, and are labeled according to their position along the waterline of the boat, as known to those of skill in the art. For example, S0 is located at the bow waterline entry of the boat, while ST is located at the transom of the boat. The remaining stations are positioned at equal intervals between S0 and S12 (i.e. between the bow and the transom).

Figure 10:
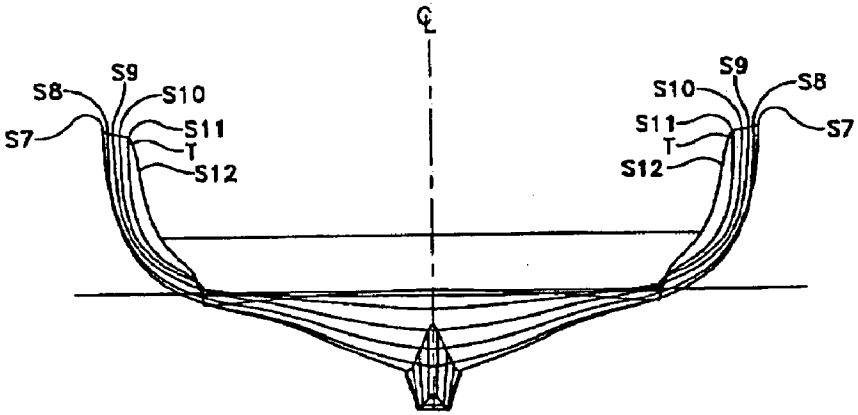
FIG. 10 is a schematic view of the hull showing the sectional lines of the stations of the hull from a rear view thereof.
Figure 10A:
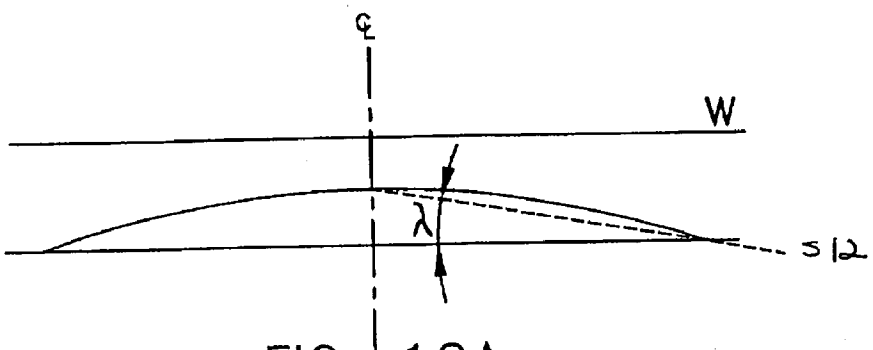
FIG. 10*a* is a schematic view of the hull showing the deadrise angle at the aft section.
Figure 9:
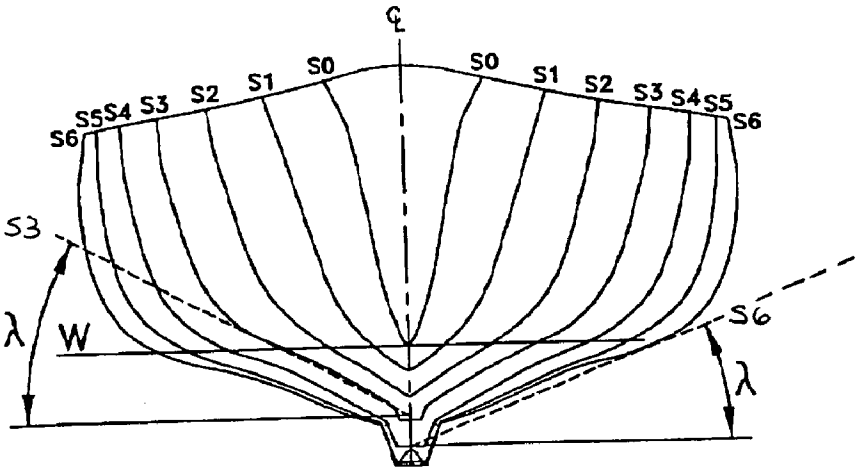
FIG. 9 is a schematic view of the hull showing the sectional lines of the stations of the hull from a front view thereof and deadrise angles at stations 3 and 6.

In the present embodiment, the angle of entry ($\Sigma$) of the boat as measured parallel with the waterline (FIG. 8) is relatively sharp at about 13 degrees, and relatively hollow. The shape of the hull is unique due largely to the provision of a negative deadrise angle ($\lambda$) at the aft sections of the hull as measured from the centerline parallel to the waterline. In conventional hull designs the deadrise angle is a positive number, and has never known to be negative in a monohull powerboat. Referring to FIGS. 9–10*a*, beginning at the forward sections of the hull (Stations 0–4), the vertical deadrise angle ($\lambda$) is at least about 52 degrees in the present embodiment. Amidship, from about stations S5–S8 is a transitional deadrise which measure approximately 20 degrees at S6 (FIG. 9). At about S8, the deadrise becomes approximately 0 degrees, and from stations S9–ST (i.e., at the aft sections of the hull) the deadrise becomes negative (FIG. 10*a*). The deadrise angle ($\lambda$) as measured at station S12 to ST, relative to the horizontal is about negative −10 degrees in the present embodiment.

Therefore, as will be appreciated, the entry of the boat is very fine, with the bow 13 having a sharp angle of entry and being generally hollowed and not curved, the deadrise angle quickly twisting out midship and becoming concave at the aft sections 14 as measured from the bottom of the boat at the centerline out to where the hull intersects the waterline. This results in a "twist" in the hull of the boat as the deadrise angle flattens out and becomes negative.

In addition to the above, the hull section is preferably turned inward and upward (inward relative to a vertical plane "V" extending through a center of the hull along the length, and upward toward the waterline 16 of the boat) from about stations S4–S8, to form a pronounced hollow 18 in the underside or bottom portion of the hull, which lies primarily below the waterline. The hollow area preferably begins at about 40% aft of the bow and continues until about 70% aft of the bow. The provision of a hull having a hollow area 18 allows for directing the flow of water aft as the boat moves through the water by directing the water from the hollow area toward the aft sections. The hollow area also induces turbulence in the water thus breaking any water skin friction or suction at the aft sections of the boat thus reducing drag and improving hull performance.

The hull of the boat may also have a width or beam "B" of a little less than about ⅓ of its length, or about 13'3" for the present embodiment. The boat hull also preferably has a reduced draft, or depth than a traditional hull styles of the same or similar size. A reduced draft is achieved because with a traditional boat stability is achieved by either increasing the depth of the boat or increasing the beam, while in the present embodiment stability is achieved by the uniqueness of the shape of the hull, allowing the depth of the hull (or draft) to be reduced. Reducing the draft allows the boat to be operated in shoal, or shallow water, having depths of 3 feet or less. For the boat of the present embodiment, the draft of the boat is less than about 2 feet of water.

The overall configuration of the hull allows the boat to have superior lift characteristics and contributes to the fuel efficiency of the boat. It is believed that water is agitated as it passes under the hull to the stem of the boat to improve the lift. The shape of the bow section which allows the bow to effectively cut through the water is also believed to improved the operation of the boat.

Any style propeller and engine or jet drive may be utilized with the hull of the present embodiment. However, it is believed that surface piercing propellers will work particularly well with hulls of the present design. During testing, a 32 foot boat having a 30 foot length at the waterline was tested with the equivalent of a 160 hp engine. The boat was towed and the drag was measured on a bollard testing device to determine horsepower, as known in the art. The boat traveled at approximately 15 knots without becoming overburdened and exhibited good stability and lift characteristics.

Thus, it will be appreciated that the improved hull design of the present invention is capable of operating at variable speeds with lesser horse power than boats utilizing traditional hull designs for the same speeds. In other words, the improved hull design obtains speeds at very low horsepower/weight ratio as compared to boats having conventional hulls which results in improved fuel economy and range. The hull of the present embodiment also has good stability and a comfortable ride as compared to conventional hulls.

It will be understood that various modifications may be made to the embodiment disclosed herein. Therefore, the above description should not be construed as limiting, but merely as exemplifications of a preferred embodiment. Those skilled in the art will envision other modifications within the scope spirit of the invention.

I claim:

1. An improved hull having a waterline, the hull including:

a forward section having a deadrise angle as measured from a centerline of the hull relative to the waterline of at least about 50 degrees;

a midship section having a deadrise angle as measured from a centerline of the hull relative to the waterline of at least about 28 degrees; and an aft section having a concave bottom as measured relative to a static waterline, the concave bottom being defined by a negative deadrise angle.

2. The improved hull of claim 1, wherein the deadrise angle is at least about negative 10 degrees at the aft section of the hull.

3. The improved hull of claim 1, further comprising a pronounced hollow area in the bottom of the hull, the hollow area positioned substantially below the waterline during operation of the boat.

4. The improved hull of claim 3, wherein the hollow area preferably begins about 40% aft of the bow and continues until about 70% aft of the bow.

5. The improved hull of claim 1, wherein the hull has a draft of less then about 3 feet during operation of the boat.

6. The improved hull of claim 1, wherein the bow has a waterline entry angle of about 13 degrees or greater.

* * * * *